US009038601B2

(12) United States Patent
Morris et al.

(10) Patent No.: US 9,038,601 B2
(45) Date of Patent: May 26, 2015

(54) FLOW LIMITER ASSEMBLY FOR A FUEL SYSTEM OF AN INTERNAL COMBUSTION ENGINE

(71) Applicant: CUMMINS INC., Columbus, IN (US)

(72) Inventors: Corydon E. Morris, Columbus, IN (US); David L. Buchanan, Westport, IN (US)

(73) Assignee: Cummins Inc., Columbus, IN (US)

( * ) Notice: Subject to any disclaimer, the term of this patent is extended or adjusted under 35 U.S.C. 154(b) by 278 days.

(21) Appl. No.: 13/666,525

(22) Filed: Nov. 1, 2012

(65) Prior Publication Data

US 2013/0104853 A1 May 2, 2013

Related U.S. Application Data

(60) Provisional application No. 61/554,117, filed on Nov. 1, 2011.

(51) Int. Cl.

| | |
|---|---|
| ***F02M 61/00*** | (2006.01) |
| ***F02M 63/00*** | (2006.01) |
| ***F02M 63/02*** | (2006.01) |
| ***F02M 55/00*** | (2006.01) |
| ***F02M 51/06*** | (2006.01) |
| *F02M 61/16* | (2006.01) |

(52) U.S. Cl.

CPC ..... *F02M 61/161* (2013.01); *F02M 63/0056* (2013.01); *F02M 63/0225* (2013.01); *F02M 55/002* (2013.01); *F02M 51/061* (2013.01); *F02M 63/0215* (2013.01)

(58) Field of Classification Search

CPC ..... F02M 63/0056; F02M 63/0215; F02M 63/0225

USPC ..... 123/467, 468, 469, 198 D; 239/533.3, 239/533.8, 533.9; 137/489

See application file for complete search history.

(56) References Cited

U.S. PATENT DOCUMENTS

| | | | | |
|---|---|---|---|---|
| 3,288,190 | A | 11/1966 | Holmes | |
| 4,071,067 | A | 1/1978 | Goldby | |
| 4,076,064 | A | 2/1978 | Holmes | |
| 4,258,607 | A | 3/1981 | McKewan | |
| RE31,284 | E | 6/1983 | Holmes | |
| 4,478,189 | A * | 10/1984 | Fenne | 123/467 |
| 4,485,969 | A | 12/1984 | Deckard et al. | |
| 4,648,369 | A * | 3/1987 | Wannenwetsch | 123/467 |
| 4,661,031 | A | 4/1987 | Heine | |
| 4,911,127 | A | 3/1990 | Perr | |
| 5,169,270 | A | 12/1992 | Erickson | |
| 5,209,403 | A | 5/1993 | Tarr et al. | |
| 5,301,875 | A | 4/1994 | Gant et al. | |
| 5,501,197 | A | 3/1996 | Smith | |

(Continued)

FOREIGN PATENT DOCUMENTS

| | | |
|---|---|---|
| EP | 1 705 365 B1 | 9/2006 |
| GB | 2 104 158 A | 3/1983 |
| GB | 2 351 773 A | 1/2001 |

*Primary Examiner* — Mahmoud Gimie

(74) *Attorney, Agent, or Firm* — Faegre Baker Daniels LLP

(57) ABSTRACT

A flow limiter for a fuel system is provided. The flow limiter includes a self-contained portion that enables testing of the flow limiter prior to assembly into a fuel system. A housing of the flow limiter is arranged to provide reduced or no pressure differential across a wall of the housing, permitting the housing to be reduced in size and thickness and providing improved consistency of operation.

21 Claims, 3 Drawing Sheets

(56) References Cited

U.S. PATENT DOCUMENTS

| | | | |
|---|---|---|---|
| 5,542,799 | A | 8/1996 | Culpen |
| 5,694,903 | A | 12/1997 | Ganser |
| 5,720,318 | A | 2/1998 | Nagarajan et al. |
| 5,819,704 | A | 10/1998 | Tarr et al. |
| 5,820,033 | A | 10/1998 | Cooke |
| 5,904,300 | A | 5/1999 | Augustin |
| 5,979,789 | A | 11/1999 | Sullivan et al. |
| 6,056,264 | A | 5/2000 | Benson et al. |
| 6,155,503 | A | 12/2000 | Benson et al. |
| 6,286,768 | B1 | 9/2001 | Vetters et al. |
| 6,298,826 | B1 | 10/2001 | Cotton, III |
| 6,378,497 | B1 | 4/2002 | Keyster et al. |
| 6,439,202 | B1 | 8/2002 | Carroll, III et al. |
| 6,655,602 | B2 | 12/2003 | Shafer et al. |
| 6,655,610 | B2 | 12/2003 | Bulgatz et al. |
| 6,840,268 | B2 | 1/2005 | Kennedy et al. |
| 6,840,500 | B2 | 1/2005 | Dallmeyer et al. |
| 6,997,165 | B2 | 2/2006 | Stockner et al. |
| 7,025,045 | B2 | 4/2006 | Hlousek |
| 7,156,368 | B2 | 1/2007 | Lucas et al. |
| 7,159,800 | B2 | 1/2007 | Peterson, Jr. |
| 7,309,033 | B2 | 12/2007 | Dallmeyer |
| 7,347,383 | B2 | 3/2008 | Dallmeyer et al. |
| 7,428,893 | B2 | 9/2008 | Shinogle et al. |
| 7,458,529 | B2 | 12/2008 | Ricco et al. |
| 7,658,179 | B2 | 2/2010 | Bock et al. |
| 7,661,410 | B1 | 2/2010 | Fuelberth et al. |
| 7,954,787 | B2 | 6/2011 | Ricco et al. |
| 8,172,161 | B2 | 5/2012 | Biagetti |
| 2009/0212134 | A1 | 8/2009 | Drake et al. |
| 2009/0236441 | A1 | 9/2009 | Hess et al. |
| 2009/0267008 | A1 | 10/2009 | Lucas et al. |
| 2010/0012753 | A1 | 1/2010 | Corbinelli et al. |

* cited by examiner

FLOW LIMITER ASSEMBLY FOR A FUEL SYSTEM OF AN INTERNAL COMBUSTION ENGINE

CROSS-REFERENCE TO RELATED APPLICATIONS

This application claims the benefit of priority to U.S. Provisional Patent Application No. 61/554,117, filed on Nov. 1, 2011, which is hereby incorporated by reference in its entirety.

TECHNICAL FIELD

This disclosure relates to flow limiters for high-pressure fuel injection systems of internal combustion engines.

BACKGROUND

Fuel injection systems are commonly used in internal combustion engines to provide fuel to the combustion chambers of such engines. While fuel injection systems provide many benefits to internal combustion engines, a fuel injection system can permit unrestricted flow of fuel to the combustion chambers under certain failure modes of the fuel injection system, such as when a fuel injector fails to close after a fuel injection event. In order to restrict the flow of fuel to a combustion chamber, a flow limiter may be provided between a high-pressure inlet to a fuel injector and an engine's combustion chamber.

SUMMARY

This disclosure provides a fuel flow limiter assembly for a high-pressure fuel system, comprising an outer housing, a flow limiter housing, and a flow limiter plunger. The outer housing contains a housing bore to receive high-pressure fuel and an inner wall forming the housing bore. The flow limiter housing includes a longitudinal axis, a first portion, a second portion positioned in the housing bore upstream from the first portion, and a fuel flow passage extending through the second portion to receive high-pressure fuel. The second portion includes an outer surface positioned a spaced radial distance from the inner wall to form a gap fluidly connected to the housing bore to receive high-pressure fuel. The flow limiter plunger is mounted in the fuel flow passage for reciprocal movement between a first position permitting fuel flow through the fuel flow passage and a second position blocking flow through the fuel flow passage.

This disclosure also provides a fuel injector for a high-pressure fuel system, comprising an injector body, an outer housing, a flow limiter housing, and a flow limiter plunger. The injector body includes a longitudinal axis, a high-pressure fuel circuit and an end surface extending transverse to the longitudinal axis. The outer housing is mounted on the injector body and the outer housing includes a housing bore to receive high-pressure fuel and a transverse face extending transverse to the longitudinal axis. The flow limiter housing includes an extension portion positioned in the housing bore, a fuel flow passage extending through the extension portion to receive high-pressure fuel for delivery to the high-pressure fuel circuit, and a flange portion positioned axially between, and in compressive abutment against, the transverse face and the end surface to securely position the extension portion in the housing bore. The flow limiter plunger is mounted in the fuel flow passage for reciprocal movement between a first position permitting fuel flow through the fuel flow passage and a second position blocking flow through the fuel flow passage.

Advantages and features of the embodiments of this disclosure will become more apparent from the following detailed description of exemplary embodiments when viewed in conjunction with the accompanying drawings.

DETAILED DESCRIPTION

Figure 1:
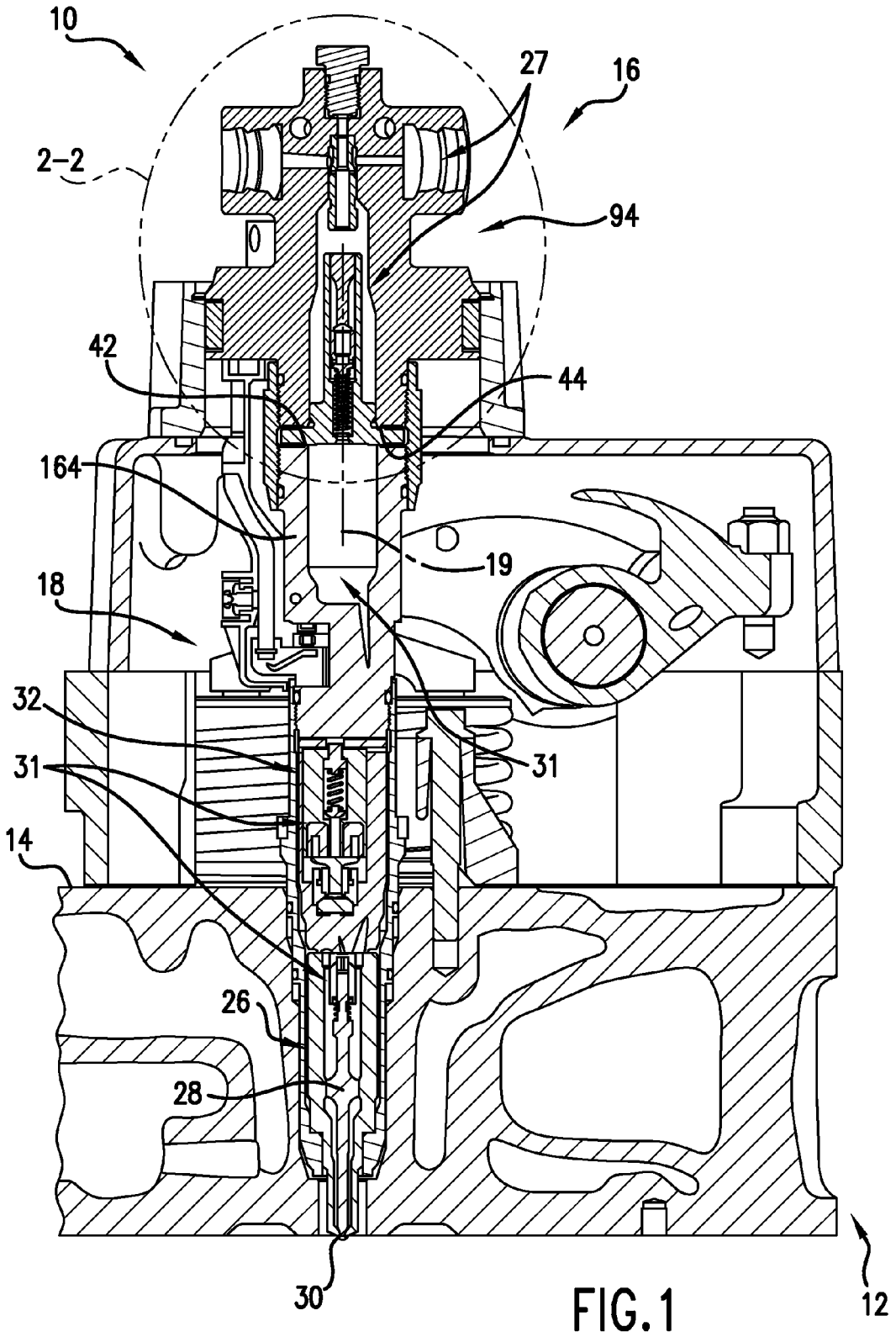
FIG. 1 is a cross-sectional view of a portion of an internal combustion engine including an exemplary embodiment of the present disclosure.

Referring to FIG. 1, a portion of an internal combustion engine is shown generally indicated at 10. Engine 10 includes an engine body 12, which includes an engine block (not shown) and a cylinder head 14 attached to the engine block. Engine 10 also includes a fuel system 16 that includes one or more fuel injectors 18, a fuel pump, a fuel accumulator, valves, and other elements (not shown) that connect to fuel injector 18.

Fuel injector 18 needs to function properly in adverse conditions, including some amount of debris in the fuel. However, if fuel injector 18 sustains structural damage, or experiences any condition that would cause unintended fuel flow from the injector, such as from one or more injector orifices, by, for example, failure of a nozzle valve element, engine 10 would prevent the unintended fueling using a fail-safe device that reduces or halts the fuel distribution function of fuel injector 18 to protect internal combustion engine 10. The fail-safe device includes a flow limiter assembly 94 to stop unintended or undesirable fueling in the event of a fuel system 16 failure.

Applicants recognized that flow limiters suffer from various challenges, including high stresses due to pressure differentials, difficulty of assembly, and difficulty to test. In previous fuel system designs, the housing for the flow limiter has significant pressure imbalance or differential between the inside and outside surfaces of the flow limiter housing. The pressure imbalance, with the high pressure on the inside of the housing, results in dilation or expansion of the limiter housing, and expansion and contraction of the housing with changes in the pressure imbalance. Because of the variation in an internal diameter of the flow limiter housing caused by the pressure imbalance, a plunger positioned within the flow limiter housing needs clearance to prevent binding with an interior wall of the flow limiter housing. However, additional clearance with the housing permits fuel to flow around the plunger, affecting the closing pressure of the flow limiter. In addition, previous flow limiter housings need to be sufficiently thick and large enough to withstand the pressure imbalance, thereby undesirably increasing the size and weight of the assembly.

Flow limiter assembly 94 positioned within engine 10 includes increased functionality, little or no differential pressure across the flow limiter housing, and improved ease of assembly. In the exemplary embodiment, flow limiter assembly 94 includes a flow limiter housing 96 and a flow limiter inlet filter 102, such as an edge filter, which is a press or interference fit with flow limiter housing 96. Because flow limiter inlet filter 102 is pressed into flow limiter housing 96, if a pressure imbalance across flow limiter housing 96 could occur, the pressure imbalance would cause flow limiter housing 96 to "breathe" or dilate, causing flow limiter inlet filter 102 to lose retention and move, which can restrict a fuel flow passage and generate debris. A pressure imbalance may also cause compression of and damage to flow limiter inlet filter 102, changing the function and characteristic of flow limiter inlet filter 102.

Fuel injector 18 includes an injection portion 26, which further includes a nozzle valve element 28, one or more injector orifices 30, a fuel injector circuit 31 extending through fuel injector 18, and a longitudinal axis 19. Injector orifices 30 provide a flow path for fuel to flow to a combustion chamber (not shown) of engine 10 during a fuel injector 18 injection event. Fuel injector 18 also includes a valve portion 32 for controlling flow of fuel to injection portion 26, and an upper body 164. Upper body 164 includes an end surface 42 that extends transversely to longitudinal axis 19.

Figure 2:
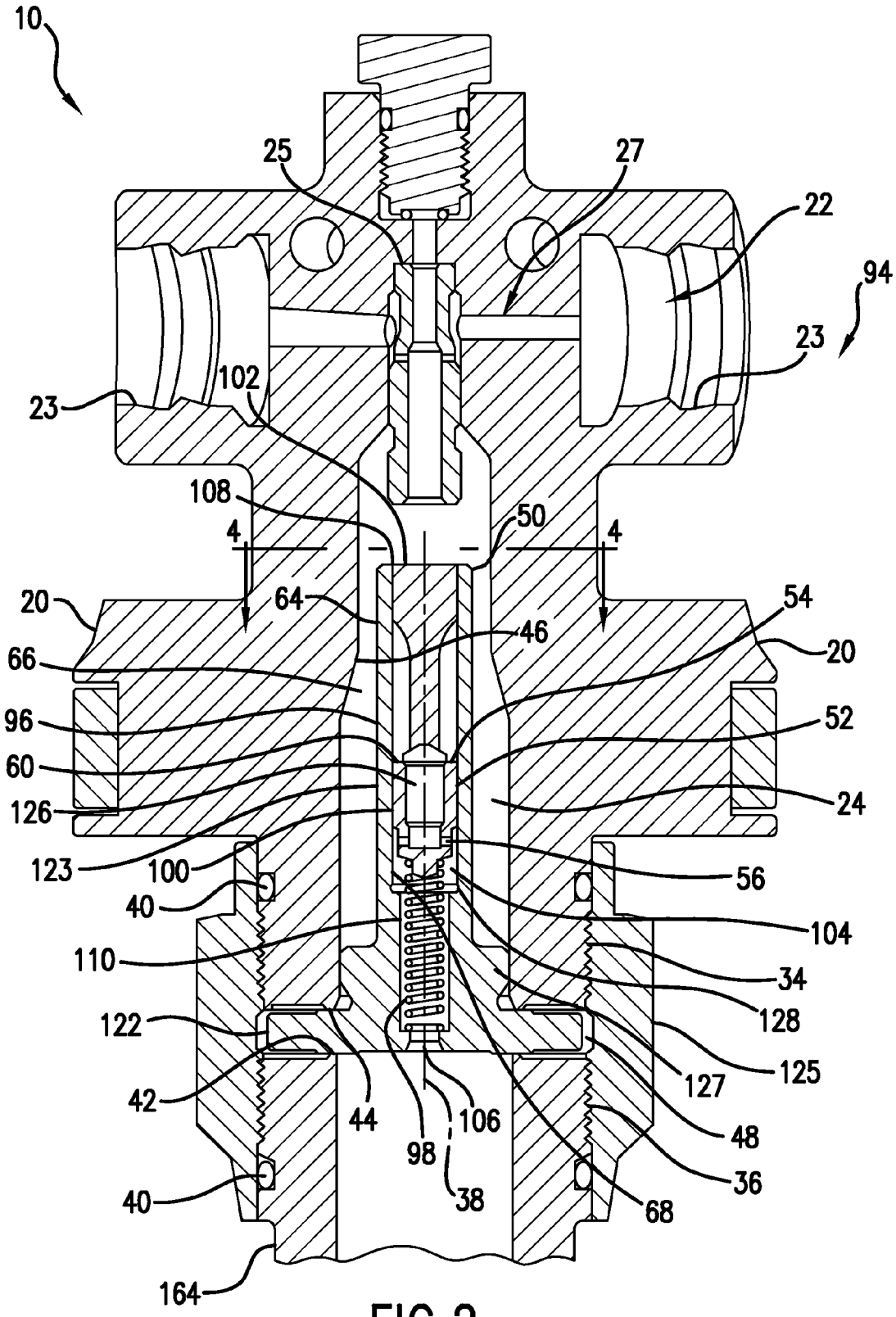
FIG. 2 is a view of a portion of the internal combustion engine of FIG. 1 along the line 2-2 including a flow limiter in accordance with an exemplary embodiment of the present disclosure.
Figure 3:
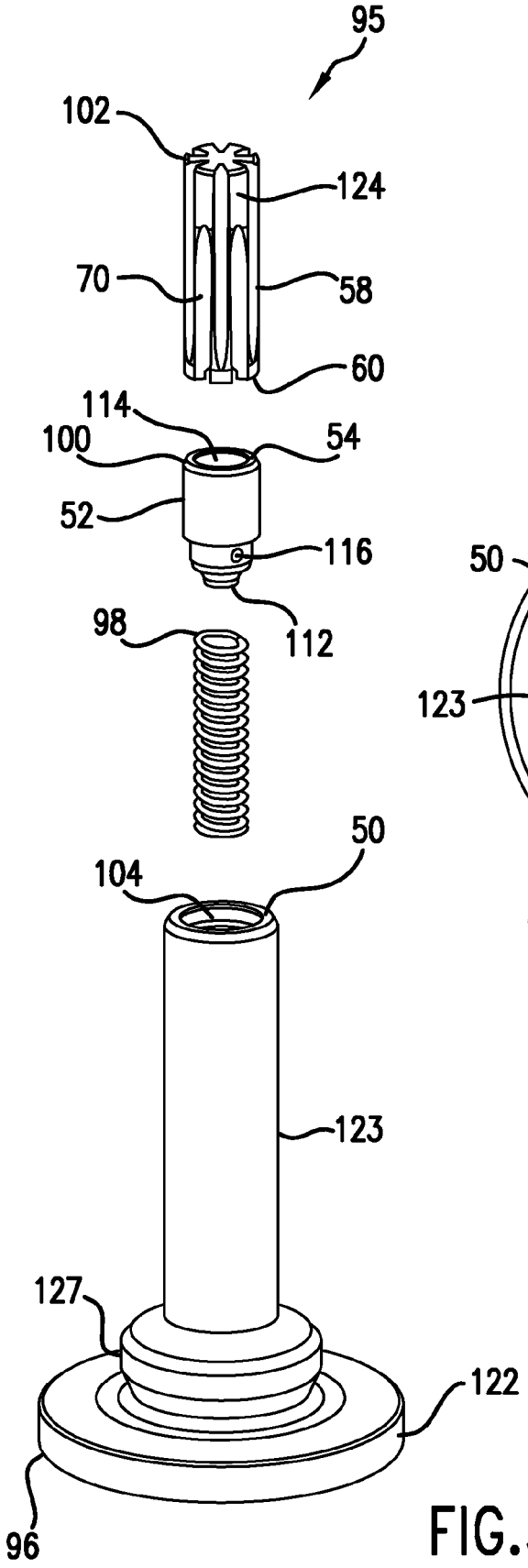
FIG. 3 is a perspective exploded view of a flow limiter sub-assembly of the flow limiter of FIG. 2.
Figure 4:
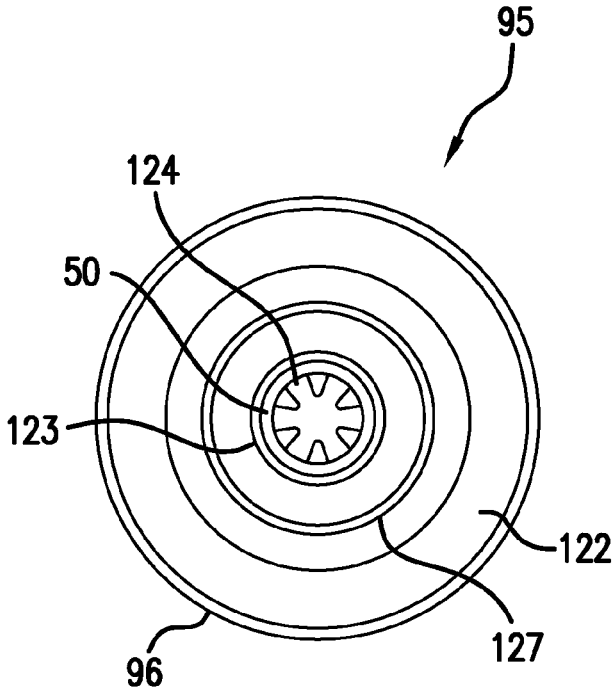
FIG. 4 is a top view of the flow limiter sub-assembly of FIG. 2 along the lines 4-4 as though the flow limiter sub-assembly was whole and with the other elements of FIG. 2 removed.

Referring now to FIGS. 2-4, flow limiter assembly 94 includes an outer housing 20, flow limiter housing 96, a flow limiter load spring 98, a flow limiter plunger 100, inlet filter 102, and a coupling 125.

Outer housing 20 includes a high-pressure inlet 22, one or more bosses 23, a housing recess or bore portion 24 formed by an inner wall 46, and a transverse face 44 that extends in a transverse direction to a longitudinal axis 38 of flow limiter assembly 94. High-pressure inlet 22 may be connected to a fuel rail or accumulator (not shown), or may be a part of a daisy chain arrangement wherein other fuel injectors may be connected via appropriate high-pressure lines to, for example, bosses 23 integrally formed in outer housing 20, either upstream or downstream of high-pressure inlet 22. An inlet fuel circuit 27 extends from high-pressure inlet 22 through outer housing 20 to connect with fuel injector circuit 31. Flow limiter assembly 94 may include a pulsation dampener 25 positioned along inlet fuel circuit 27 upstream from flow limiter housing 96, which serves to reduce transmission of pulsation waves, caused by injection events, between fuel injectors. A portion of flow limiter housing 96 extends into housing recess or bore portion 24. Outer housing 20 may be attached to fuel injector upper body 164 by coupler 125. Such attachment may be to outer housing 20 by way of threads 34 formed on outer housing 20 and mating threads formed on coupler 125 and to fuel injector upper body 164 by way of threads 36 formed on upper body 164 and mating threads formed on coupler 125. Seals 40 may be positioned between coupler 125 and outer housing 20 and between coupler 125 and upper body 164.

Flow limiter housing 96 includes a first or flange portion 122 and a second or extension portion 123 that extends along longitudinal axis 38 that is perpendicular to first or flange portion 122. Second or extension portion 123 includes a cylindrical housing wall 50 forming a fuel flow passage 104. Cylindrical housing wall 50 includes an inner surface 68 on which is formed a plunger seat 128. Cylindrical housing wall 50 includes an outer surface 64. Fuel flow passage 104 includes an outlet orifice 106 at a first, downstream, or proximate end, and a flow limiter housing cavity opening 108 at a second, upstream, or distal end opposite the second end. Fuel flow passage 104 may have a smaller diameter or narrow portion 110. Flow limiter housing 96 may also include a guide portion 127 having a transverse width or extent greater than a transverse width or extent of second portion 123 and smaller than a transverse width or extent of first portion 122.

Flow limiter housing 96 may be captured between end surface 42 of upper body 164 and transverse face 44 of outer housing 20. More specifically, housing flange portion 122 is positioned in compressive abutment with end surface 42 and transverse face 44 when coupler 125 is secured to upper body 164 and when outer housing 20 is secured to coupler 125. Cylindrical housing wall 50 of second portion 123 extends into housing recess or bore 24. Outer surface 64 is a spaced radial distance from inner wall 46, forming a radial gap 66, which may extend longitudinally from the distal end of second portion 123 to end in a location that is beyond the entire length of flow limiter plunger 100, as shown in FIG. 2. Radial gap 66 may extend annularly about second portion 123. If radial gap 66 extends annularly about second portion 123 and along the length of second portion 123, then second portion 123 is unsupported radially by inner wall 46 or free from contact with inner wall 46 of outer housing 20. Guide portion 127 is located within housing recess or bore 24 and may contact inner wall 46. Guide portion 127 is a slip fit within housing recess 24 and serves to center extension portion 123 within housing recess or bore 24. A clearance gap 48 between a periphery of flange portion 122 and an interior of coupler 125 prevents flange portion 122 from binding on coupler 125 during assembly.

Flow limiter spring 98, flow limiter plunger 100, and inlet filter 102 are positioned in fuel flow passage 104. A proximate end of flow limiter plunger 100 includes a protrusion 112 that mates with an interior of flow limiter load spring 98 when flow limiter plunger 100 is positioned within flow limiter assembly 94. The distal end of flow limiter plunger 100 includes a cylindrical plunger wall 52 forming a plunger cavity 126. Plunger wall 52 includes a plunger end face 54. A plunger inlet 114 is located at a distal end of flow limiter plunger 100. One or more transverse passages 56 connect plunger cavity 126 to one or more plunger outlet openings 116 formed on an exterior surface of flow limiter plunger 100. Plunger 100 is sized and dimensioned to provide a substantial fluid seal with inner surface 68 of cylindrical housing wall 50 while permitting plunger 100 to move reciprocally in fuel flow passage 104.

Inlet filter 102 limits the effects of debris in the fuel and includes a filter element 124 and a structural portion 58 that extends in a longitudinal direction. Structural portion 58 includes a structure end surface 60 at a proximate end. Structural portion 58 includes one or more gaps or spaces 70 that permit fuel to flow from filter element 124 toward a proximate end of inlet filter 102.

Flow limiter spring 98 is inserted into fuel flow passage 104 through flow limiter housing cavity opening 108 and located within narrow portion 110 of fuel flow passage 104. After flow limiter spring 98 is inserted through opening 108 and located in portion 110, flow limiter plunger 100 is inserted through opening 108 and interfaces with flow limiter spring 98 via protrusion 112 formed on flow limiter plunger 100.

To retain flow limiter spring 98 and flow limiter plunger 100 within fuel flow passage 104, inlet filter 102 engages cylindrical housing wall 50 with an interference type fit. Inlet filter 102 may serve as a stop for flow limiter plunger 100. Inlet filter 102 is inserted into flow limiter fuel flow passage 104 until structure end surface 60 is in abutting contact with plunger end face 54 and causes flow limiter load spring 98 to compress by an amount that prevents flow limiter plunger 100 from moving under fuel flow from a normal fuel injection event. The strength of the material for structural portion 58 and the contact area between structure end surface 60 and plunger end face 54 is such that structural portion 58 receives no damage from plunger 100 when it contacts end face 54 under the force of flow limiter load spring 98. Because flow limiter load spring 98 compresses only under a failure mode of fuel system 16, structural portion 58 of inlet filter 102 is subjected to relatively little stress. Thus, the material of structural portion 58 may include engineering polymers or an appropriate metal.

Once inlet filter 102 is press fit into flow limiter housing cavity 104, flow limiter load spring 98, flow limiter plunger 100, inlet filter 102 and flow limiter housing 96 form a self-contained flow limiter sub-assembly 95. Since flow limiter sub-assembly 95 is fully contained, functional testing of flow limiter sub-assembly 95 may take place prior to assembly of flow limiter sub-assembly 95 into engine 10. The creation of a self-contained flow limiter sub-assembly 95 also reduces fuel system 16 assembly cycle time.

High-pressure fuel flow through flow limiter sub-assembly 95 begins at the distal end of flow limiter sub-assembly 95 through filter element 124, which is part of flow limiter inlet filter 102. Once through filter element 124, high-pressure fuel flows into fuel flow passage 104 and into plunger inlet 114 located at the distal end of flow limiter plunger 100, which is in a first, or normal, position. Fuel next flows through plunger cavity 126 of flow limiter plunger 100. Fuel exits flow limiter plunger 100 through transverse passages 56 formed in flow limiter plunger 100, exiting flow limiter plunger 100 at plunger outlet opening(s) 116. When flow limiter sub-assembly 95 is assembled, flow limiter load spring 98 is compressed or pre-loaded by a certain amount. The flow of high-pressure fuel under normal conditions through transverse passages 56 and through plunger outlet opening(s) 116 causes a pressure drop through transverse passages 56, but the pressure drop is insufficient to cause flow limiter plunger 100 to compress flow limiter load spring 98. Thus, under normal operation, flow limiter plunger 100 does not move during a fuel injection event. High-pressure fuel flows from plunger outlet opening(s) 116 past flow limiter spring 98 in narrower portion 110 of flow limiter fuel flow passage 104. Fuel exits flow limiter cavity portion 104 by way of outlet orifice 106, flowing into upper body 164.

Because the pressure drop across filter element 124 is negligible, the pressure on the outside of flow limiter housing 96 in radial gap 66 and the pressure on the inside of flow limiter housing 96 in flow limiter cavity portion 104 is approximately the same. Thus, flow limiter housing 96 does not have the pressure imbalances of existing flow limiter housings. Because the pressure differential across flow limiter housing 96 is near zero, inlet filter 102 remains secure in flow limiter housing 96 under varying flow conditions, including temperature changes in the fuel and the surrounding components and viscosity changes in the fuel. Additionally, flow limiter housing 96 may be smaller and thinner than previous flow limiter housings since it does not need to resist the force of a pressure differential. The decreased size of flow limiter housing 96 consequently permits a reduction in size of outer housing 20, providing a more compact flow limiter assembly 94. Because flow limiter assembly 94 is reduced in size, engine 10 becomes more compact or presents more space for other engine 10 features.

In the event that fuel injector 10 sustains damage and initiates an uncontrolled fueling event, high-pressure fuel will attempt to flow at an accelerated rate through flow limiter assembly 94 because of the pressure of the fuel flowing into housing recess or cavity 24. As noted hereinabove, flow limiter plunger 100 forms a substantial fluid seal with interior surface 68 of cylindrical housing wall 50, while being sized and dimensioned to permit reciprocal movement in fuel flow passage 104. The substantial fluid seal forces fuel to flow through plunger cavity 126 and transverse passage(s) 56. The dimensions of transverse passage(s) 56 cause a pressure drop across flow limiter plunger 100. Because of the pressure drop caused by the increased volume of high-pressure fuel flowing through transverse passages 56 and plunger outlet opening(s) 116, flow limiter plunger 100 will compress flow limiter spring 98, moving flow limiter plunger 100 to a second or closed position against plunger seat 128. In the second or closed position, flow limiter plunger 100 will cut off all fuel flow through fuel flow passage 104, preventing an undesirable uncontrolled fueling event. Because of the negligible pressure drop across cylindrical housing wall 50 of flow limiter housing 96, cylindrical housing wall 50 remains uncompressed or unexpanded during an uncontrolled fueling event. Because the interior diameter of cylindrical plunger wall 50 remains unaffected by pressure differential, the clearance between cylindrical plunger wall 52 and inner surface 68 of cylindrical housing wall 50 is maintained throughout operation, improving the consistency of a pressure drop across flow limiter plunger 100.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. A fuel flow limiter assembly for a high-pressure fuel system, comprising:

an outer housing containing a housing bore to receive high-pressure fuel and an inner wall forming the housing bore;

a flow limiter housing including a longitudinal axis, a first portion, a second portion positioned in the housing bore upstream from the first portion, and a fuel flow passage extending through the second portion to receive high-pressure fuel, the second portion including an outer surface positioned a spaced radial distance from the inner wall to form a gap fluidly connected to the housing bore to receive high-pressure fuel; and a flow limiter plunger mounted in the fuel flow passage for reciprocal movement between a first position permitting fuel flow through the fuel flow passage and a second position blocking flow through the fuel flow passage.

2. The assembly of claim 1, wherein the gap extends axially along the longitudinal axis an entire length of the flow limiter plunger.

3. The assembly of claim 1, further including a filter positioned in the fuel flow passage upstream of the flow limiter plunger.

4. The assembly of claim 3, wherein the gap extends axially along the longitudinal axis an entire length of the filter.

5. The assembly of claim 4, wherein the gap extends axially along the longitudinal axis an entire length of the flow limiter plunger.

6. The assembly of claim 1, wherein the second portion includes an upstream distal end, the gap extending annularly around the second portion and extending axially from the upstream distal end along the entire length of the flow limiter plunger to cause the second portion to be radially unsupported by the inner wall of the outer housing.

7. The assembly of claim 1, wherein the first portion is positioned in sealing abutment against the outer housing.

8. The assembly of claim 1, wherein the outer housing includes a transverse face extending transversely to the longitudinal axis, the first portion including a flange having a transverse extent larger than a transverse extent of the second portion and positioned in abutment against the transverse face.

9. The assembly of claim 8, including a guide portion positioned between the first portion and the second portion having a transverse extent larger than the transverse extent of the second portion and smaller than the transverse extent of the first portion.

10. The assembly of claim 1, wherein the second portion includes a cylindrical wall separating the gap and the fuel flow passage.

11. The assembly of claim 1, including a plunger seat formed within the fuel flow passage and the flow limiter plunger contacts the plunger seat in the second position.

12. A fuel injector for a high-pressure fuel system, comprising:

an injector body including a longitudinal axis, a high-pressure fuel circuit and an end surface extending transverse to the longitudinal axis;

an outer housing mounted on the injector body and including a housing bore to receive high-pressure fuel and a transverse face extending transverse to the longitudinal axis;

a flow limiter housing including an extension portion positioned in the housing bore, a fuel flow passage extending through the extension portion to receive high-pressure fuel for delivery to the high-pressure fuel circuit, and a flange portion positioned axially between, and in compressive abutment against, the transverse face and the end surface to securely position the extension portion in the housing bore; and a flow limiter plunger mounted in the fuel flow passage for reciprocal movement between a first position permitting fuel flow through the fuel flow passage and a second position blocking flow through the fuel flow passage.

13. The fuel injector of claim 12, wherein the extension portion extends along the longitudinal axis away from the injector body.

14. The fuel injector of claim 12, wherein the second portion includes a cylindrical wall separating the gap and the fuel flow passage.

15. The fuel injector of claim 12, wherein the outer housing further includes an inner wall forming the housing bore, said extension portion being free from contact with the inner wall.

16. The fuel injector of claim 12, including a guide portion positioned between the extension portion and the flange portion, the guide portion having a transverse extent larger than a transverse extent of the extension portion and smaller than a transverse extent of the flange portion.

17. The fuel injector of claim 12, including a plunger seat formed within the fuel flow passage and the flow limiter plunger contacts the plunger seat in the second position.

18. The fuel injector of claim 12, the flow limiter plunger including a plunger cavity and at least one transverse passage extending from the plunger cavity to an exterior of the flow limiter plunger.

19. The fuel injector of claim 12, including a filter positioned in the flow limiter housing and the flow limiter plunger including a plunger end face, the filter including a structure end surface, and the plunger end face is in abutting contact with the structure end face when the flow limiter plunger is in the first position.

20. The fuel injector of claim 12, including a spring positioned in the fuel flow passage to bias the flow limiter plunger in the first position.

21. A fuel flow limiter assembly for a high-pressure fuel system, comprising:

an outer housing containing a housing bore to receive high-pressure fuel and an inner wall forming the housing bore;

a flow limiter housing including a longitudinal axis, a first portion, a second portion positioned in the housing bore upstream from the first portion, and a fuel flow passage extending through the second portion to receive high-pressure fuel, the second portion including an outer surface positioned a spaced radial distance from the inner wall to form a gap fluidly connected to the housing bore to receive high-pressure fuel; and a flow limiter plunger mounted in the fuel flow passage for reciprocal movement between a first position permitting fuel flow through the fuel flow passage and a second position blocking flow through the fuel flow passage, wherein the gap extends axially along the longitudinal axis an entire length of the flow limiter plunger.

* * * * *